US009746275B1

(12) United States Patent
Popov et al.

(10) Patent No.: US 9,746,275 B1
(45) Date of Patent: Aug. 29, 2017

(54) SPLIT CAMS FOR A COMPOUND ARCHERY BOW

(71) Applicants: Sergey Popov, Moscow (RU); Vladimir Sinitsa, Moscow (RU); Liudmila Kezhina, Moscow (RU)

(72) Inventors: Sergey Popov, Moscow (RU); Vladimir Sinitsa, Moscow (RU); Liudmila Kezhina, Moscow (RU)

( * ) Notice: Subject to any disclaimer, the term of this patent is extended or adjusted under 35 U.S.C. 154(b) by 0 days.

(21) Appl. No.: 15/409,795

(22) Filed: Jan. 19, 2017

(51) Int. Cl.
*F41B 5/10* (2006.01)

(52) U.S. Cl.
CPC ..... *F41B 5/105* (2013.01); *F41B 5/10* (2013.01)

(58) Field of Classification Search
CPC ..... F41B 5/10; F41B 5/105
See application file for complete search history.

(56) References Cited

U.S. PATENT DOCUMENTS 3,990,425 A 11/1976 Ketchum
5,368,006 A 11/1994 McPherson
6,474,324 B1 * 11/2002 Despart ..... F41B 5/10 124/25.6
7,441,555 B1 10/2008 Larsen
8,281,775 B1 * 10/2012 Larson ..... F41B 5/10 124/25.6
8,443,791 B2 * 5/2013 Miller ..... F41B 5/10 124/25.6
2006/0011190 A1 * 1/2006 Andrews ..... F41B 5/105 124/89
2010/0206284 A1 8/2010 Popov et al.

* cited by examiner

*Primary Examiner* — John Ricci
(74) *Attorney, Agent, or Firm* — Andrew W. Chu; Craft Chu PLLC

(57) ABSTRACT

The split cam for a compound archery bow includes a pair of limbs, each limb having a respective loose end and at least two portions. End members are installed on the loose ends, and each end member has a pulley for a bowstring and two attachments for two cables. In between the loose ends, a first cable and a second cable are located on the same side of the bowstring. For each limb, at least one portion of the limb separates the respective pulley from at least one of the attachments for the first cable and the second cable. The portions may be of different resilience. The cam provides for convenient operation of a compound archery bow, increases initial speed of an arrow when shooting, and increases strength and reliability.

11 Claims, 10 Drawing Sheets

SPLIT CAMS FOR A COMPOUND ARCHERY BOW

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to compound archery bows, such as bows and crossbows, in particular, to cams for the compound archery bows.

2. Description of Related Art Including Information Disclosed Under 37 CFR 1.97 and 37 CFR 1.98.

Various designs of cams for compound archery bows are known in the art. Thus, U.S. Pat. No. 3,990,425 describes a bow with a cam comprising two limbs, each limb having a loose end, while the other ends of the limbs are connected with a handle. There are end members installed on the loose ends each of which includes a pulley for a bowstring and attachments for two cables. In the area of the loose end, each limb is divided into two portions with the pulley for the bowstring and the attachments located therebetween. Since the cables and the bowstring form a single continuous string such that the cables are crossed, friction appears between the cables when using the bow causing energy losses of an arrow and rapid wear-out of the cable.

U.S. Pat. No. 5,368,006 discloses a cam for an archery bow with cables and a bowstring being individual members. In the area of a loose end, each limb of the cam is divided into two portions with a pulley for the bowstring and attachments for the cables located therebetween. The cables are located on both sides of the bowstring and close to each other, since the pulley for the bowstring and the attachments, in fact, form a single member. Close positioning of the cables to the bowstring causes the cables to interfere with an arrow during a shot, thus requiring additional means to be used to retract the cables from the bowstring. Furthermore, like in the above case, the cables are crossed, resulting in friction energy losses and wear-out of the cable.

In a cam disclosed in U.S. Pat. No. 7,441,555, a bowstring is also located between two cables. However, in order to minimize the disadvantages of the cam of the U.S. Pat. No. 5,368,006, a portion of a limb is located between a pulley for the bowstring and each of attachments for the cables. This design suffers from an inconvenient way to set an arrow which is to be placed into the area confined by the cables going in parallel to the bowstring and on both sides thereof when the cam is in a free condition.

The closest prior art to the claimed invention is a cam for a compound archery bow according to patent application US20100206284. The application combines the advantages of the above bows and cams, namely, teaches cables to be located on the one side of a bowstring and being individual members. This is achieved by making such an end member which attachments for the cables are separated from a pulley for the bowstring and located on the one side of the pulley for the bowstring. However, this cam has a significant disadvantage that the cams according to U.S. Pat. No. 7,441,555 and U.S. Pat. No. 5,368,006 lack. Since in the US20100206284 the pulley for the bowstring is located not between the attachments for the cables but aside of them, and when pulling, a travel of the bowstring slightly exceeds a travel of the cables, lateral load appears acting on an axis supporting the pulley for the bowstring and the attachments for the cables. When the bowstring is strained, said axis tends to misalign thus causing increased wear of areas where end members are attached to loose ends and a stricter requirement to manufacturing quality of the axis, the pulley for the bowstring, the attachments for the cables and portions of limbs.

BRIEF SUMMARY OF THE INVENTION

The invention is aimed at designing a cam for compound archery bows that eliminates the disadvantages of the cams known in the art including those described above.

The invention provides convenient operation of the compound archery bow, increased initial speed of an arrow when shooting, and increased strength and reliability of the cam.

This is achieved in a cam for a compound archery bow that includes a first limb, a second limb, a first end member and a second end member installed on loose ends of the first limb and the second limb, respectively, and connected by a bowstring and a first cable and a second cable. In the area between the loose ends of the first limb and the second limb, the first cable and the second cable are located on the same side of the bowstring. The first end member and the second end member include a first pulley and a second pulley for the bowstring, respectively, and a first attachment and a second attachment for the first cable and the second cable, respectively. The bowstring is partially located on peripheral surfaces of the first pulley and the second pulley. The first limb and second limb each consists of at least two portions. At least one of the portions of the first limb is located between the first pulley and at least one of the first attachment for the first cable and the first attachment for the second cable. At least one of the portions of the second limb is located between the second pulley and at least one of the second attachment for the first cable and the second attachment for the second cable.

The cam addresses several issues faced by developers in the art, namely, increasing shooting comfort by locating both the cables on the same side of the bowstring, eliminating any contact between the cables, and substantially decreasing lateral loads on axes supporting the first end member and the second end member.

Further improvements of the claimed cam for compound archery bows are possible.

In particular, all attachments for the cables or only some of them can be made as a pulley having a peripheral surface where the respective cable is partially located, or said attachments can be made in the form of a fixing means.

Preferably, the first attachment and the second attachment for the first cable are located closer to the first pulley and the second pulley for the bowstring, respectively, than the first attachment and the second attachment for the second cable.

To further compensate forces acting on the axes due to different strain of the bowstring and the cables, it is preferable when at least two portions of said at least two portions of the first limb have various resilience properties. In a similar way, it is preferable when at least two portions of said at least two portions of the second limb have various resilience properties. In a particular case, resilience properties of the first limb and the second limb being an extension of each other are the same.

In a particular embodiment, the first pulley and the second pulley are separated from the respective first attachment and the second attachment with one portion of each of the first limb and the second limb, and there are no limbs between the first attachment and the second attachment. Either two portions of the first limb and the second limb surrounding the first pulley and the second pulley or the first attachment and the second attachment can be used, or rather three portions of the first limb and the second limb can be used, located above (in front of) the pulleys for the bowstring, between the pulleys for the bowstring and the first attachment and the second attachment, as well as beneath (under, or behind) the first attachment and the second attachment.

In another embodiment, the first attachment and the second attachment of the first cable are separated from the first attachment and the second attachment of the second cable, respectively, with at least one portion of the first limb and the second limb, respectively. There can also be another pair of portions each installed above the first pulley and the second pulley.

In yet another embodiment, the first pulley and the second pulley for the bowstring are separated from the respective attachments with at least two portions of each of the first limb and the second limb.

There are also other embodiments possible as discussed in detail below.

The claimed cam for compound archery bows can be used both in a bow and in a crossbow, since a design of the cam is suitable for both said arrow throwing devices.

BRIEF DESCRIPTION OF THE SEVERAL VIEWS OF THE DRAWINGS

The invention is further explained with references made to the figures that represent some possible embodiments.

DETAILED DESCRIPTION OF THE INVENTION

Figure 1:
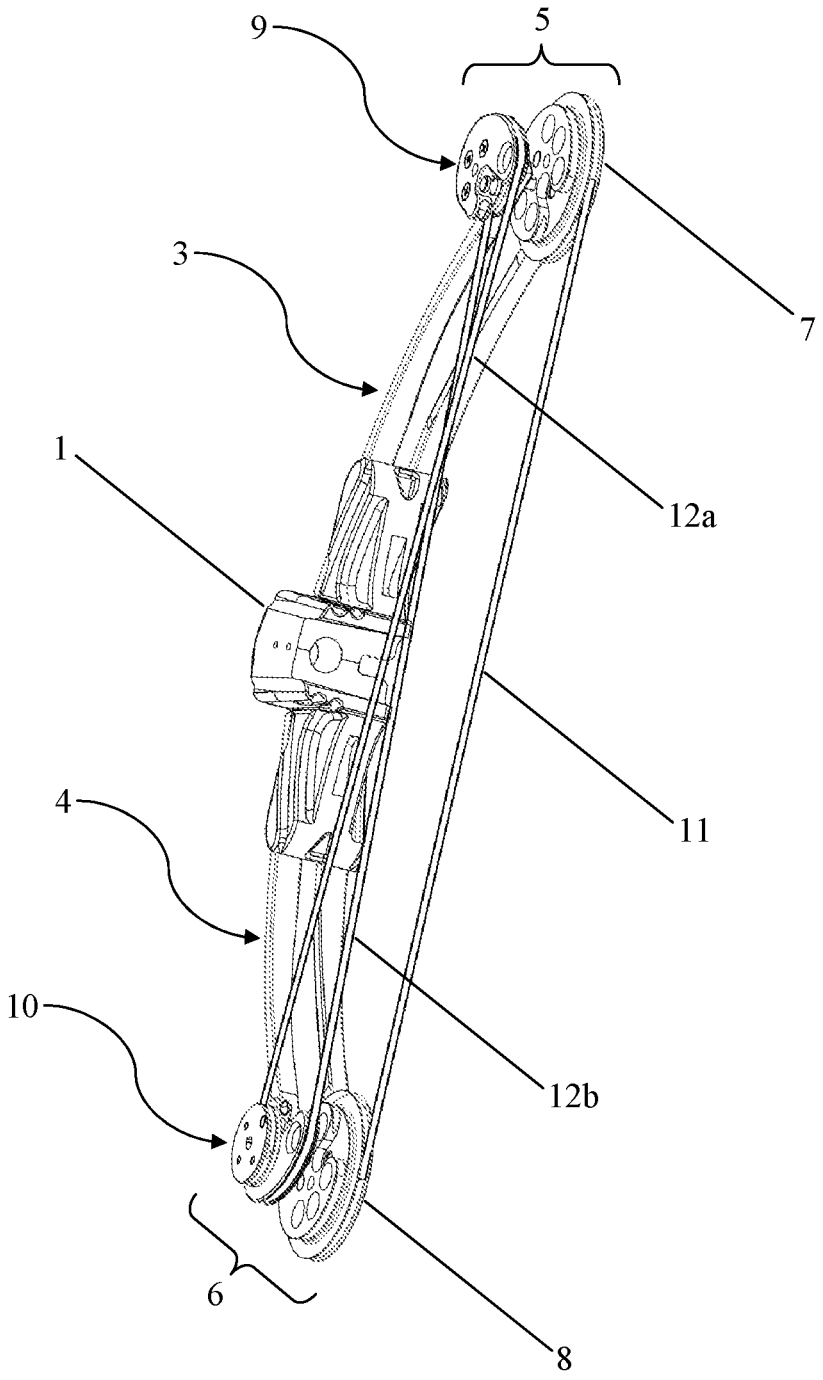
FIG. 1 shows a perspective view of an embodiment of a compound archery bow with the cam according to the invention.
Figure 2:
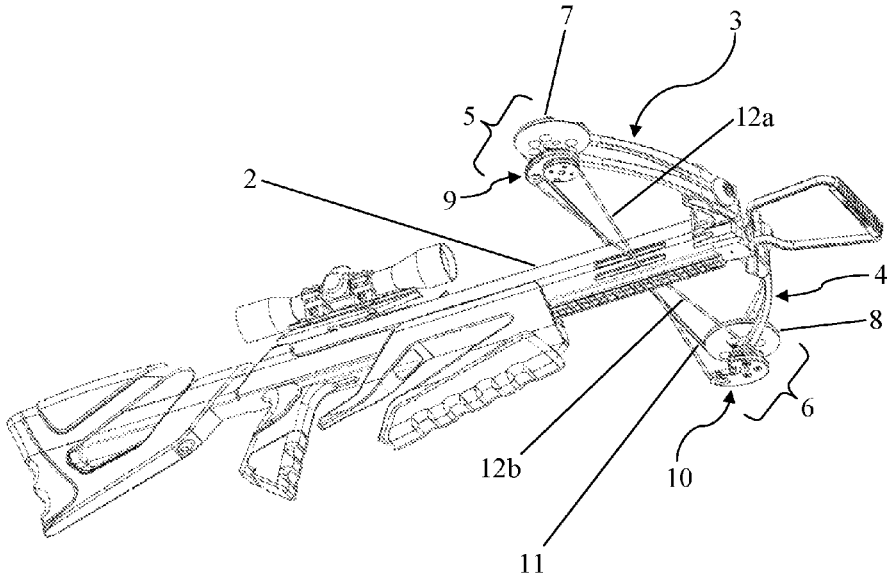
FIG. 2 shows a perspective view of an embodiment of a cross-bow with the cam according to the invention.

The proposed cam can be used in an arrow throwing device, in particular, in a bow (FIG. 1) or in a cross-bow (FIG. 2). Limbs 3, 4 are attached with their ends to a handle 1 of the bow or a base 2 of the cross-bow. End members 5, 6 are installed and can rotate on other ends of the limbs 3, 4, namely, on loose ends of the limbs 3, 4—a first loose end and a second loose end, respectively. The end members 5, 6 include a first pulley 7 for a bowstring 11 and a second pulley 8 for the bowstring 11, a first attachment 9 for a first cable 12*a* and a second cable 12*b*, and a second attachment 10 for the first cable 12*a* and the second cable 12*b*. The pulleys 7, 8, the first attachment 9 and the second attachment 10 are installed on an axis 13*a* and an axis 13*b*, respectively, as shown in FIGS. 4-10.

Figure 3A:
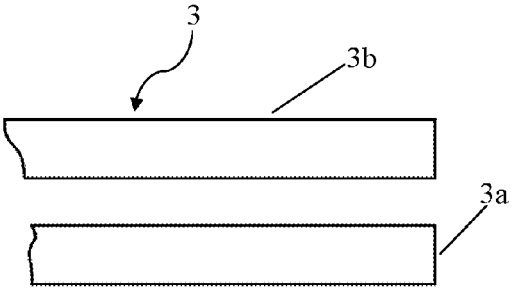
FIGS. 3*a-e* are schematic views, showing embodiments of the loose end of the limb according to the invention.
Figure 3B:
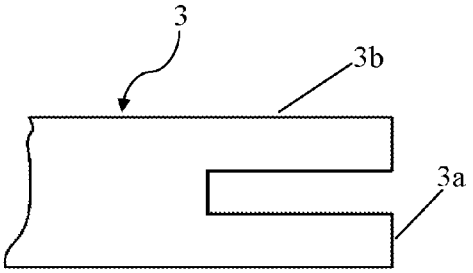
Figure 3C:
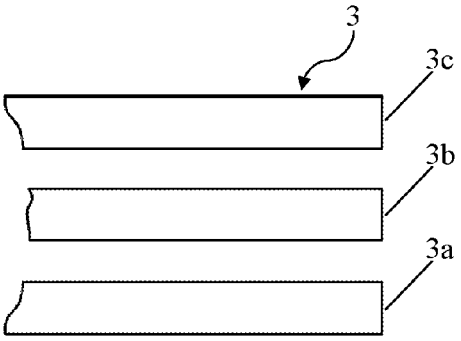
Figure 3D:
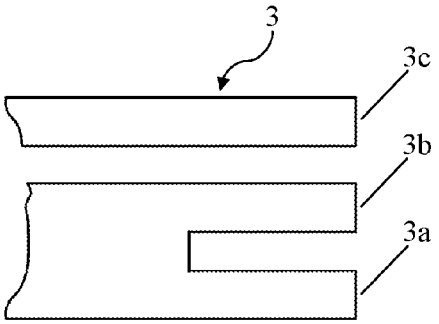
Figure 3E:
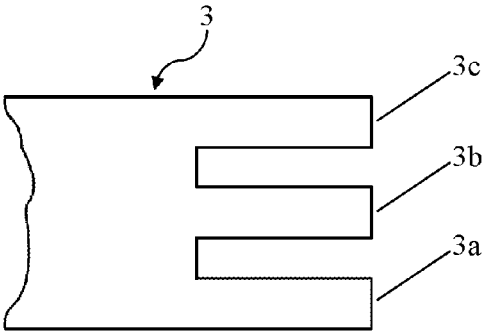

According to some embodiments of the invention, the limb 3 and the limb 4 comprise two portions—portions 3*a*, 3*b* and portions 4*a*, 4*b*, respectively. For the limb 3, this is schematically shown in FIGS. 3*a*, 3*b*. However, FIGS. 3*c*, 3*d*, 3*e* show another possible embodiments of the invention according to which the limb 3 and the limb 4 include three portions—portions 3*a*, 3*b*, 3*c* (shown in FIGS. 3*c*, 3*d*, 3*e*) and portions 4*a*, 4*b*, 4*c* (not shown). It will be understood to the one skilled in the art that the limbs 3, 4 can have more portions, so respective embodiments are not represented on the drawings.

The portions 3*a*, 3*b*, 3*c* and the portions 4*a*, 4*b*, 4*c* may extend to the entire length of the limbs 3, 4, which, for instance, corresponds to the embodiments of the bow 1 and the cross-bow 2 as shown in FIGS. 1, 2, as well as in FIGS. 3*a*, 3*c* where only area of the first loose end of the limb 3 is shown for simplicity. Alternatively, the portions 3*a*, 3*b*, 3*c* and the portions 4*a*, 4*b*, 4*c* may extend only to a specific length from the loose ends of the limbs 3, 4, at least in the areas of the first loose end and the second loose end, as schematically shown in FIGS. 3*b*, 3*e* for the limb 3. If the limb has three portions as shown in FIG. 3*d*, a combined limb design is possible where one portion of the limb, e.g. the portion 3*c*, extends to the entire length of the limb 3, and the other two portions, e.g. the portions 3*a*, 3*b*, extend only to a specific length from the first loose end of the limb 3.

In the area between the loose ends of the first limb 3 and the second limb 4, the first cable 12*a* and the second cable 12*b* are located on the same side of the bowstring 11. It means that projections of the first cable 12*a* and the second cable 12*b* onto a first plane, the first plane going through the bowstring 11 and being perpendicular to a second plane where the limbs 3, 4 lie, are located on the same side of a projection of the bowstring 11 onto said first plane.

The limbs 3, 4 can be made such that at least two of the portions 3*a*, 3*b* (if there are two portions) or of the portions 3*a*, 3*b*, 3*c* (if there are three portions) and of the portions 4*a*, 4*b* (if there are two portions) or of the portions 4*a*, 4*b*, 4*c* (if there are three portions), respectively, have different resilience. For example, the portions 3*a* and 3*b* have different resilience, or the portions 3*a* and 3*b* have similar resilience but different from that of the portion 3*c*. The portions of the limbs 3, 4 which represent an extension of each other, such as the portions 3*a* and 4*a*, or the portions 3*b* and 4*b* etc., may preferably have similar resilience.

Referring to the portions 3*a*, 3*b* of the limb 3 having different resilience, in this invention the terms "different resilience" or "different resilience properties" mean that the portion 3*a* and the portion 3*b* bend to different angles when exposed to the same loading applied to each of the portions 3*a* and 3*b*.

Different resilience of the portions 3*a*, 3*b* of the limb 3 can be ensured by various designs of the portions 3*a*, 3*b*. For example, the portions 3*a*, 3*b* can be made of materials having different mechanical properties responsible for their flexibility, resilience, rigidity etc. It is also possible that the portions 3*a*, 3*b* are made of the same material but have cross-sections of different shapes, for example, at least in the area of the first loose end of the limb 3 the portion 3*a* is narrower or wider than the portion 3*b*.

Figure 4A:
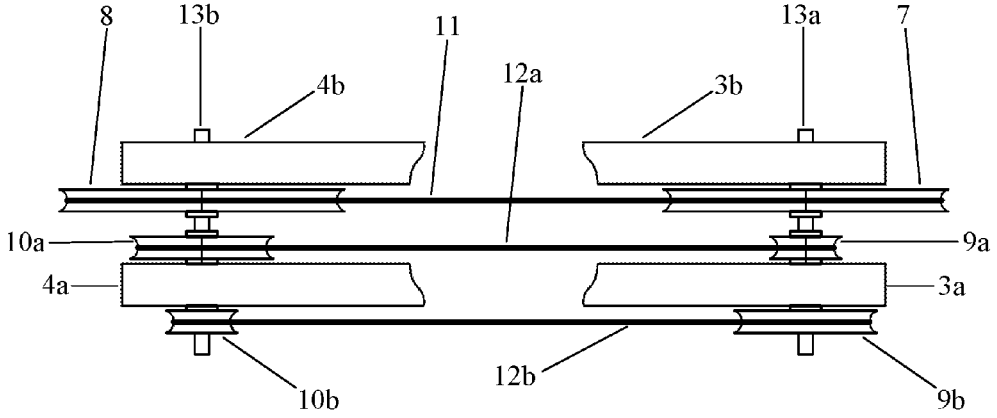
FIGS. 4*a*, 4*b*, 5*a*, 5*b*, 6*a*, 6*b*, 7*a*, 7*b*, 8*a*, 8*b*, 9*a*, 9*b*, 10*a*, and 10*b* are schematic views, showing embodiments of the cam according to the invention.
Figure 4B:
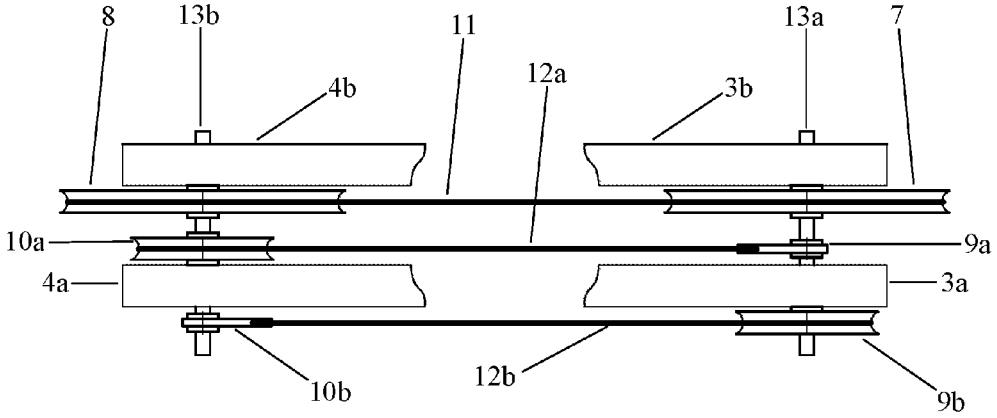

The attachments 9, 10 for the cables 12*a*, 12*b* may be made in the form of pulleys or fixing means. For example, FIG. 4*a* shows that the cable 12*a* is attached with the one end thereof to an attachment 9*a* in the form of a pulley and with the other end thereof to an attachment 10*a* in the form of a pulley, while the cable 12*b* is attached with one end thereof to an attachment 9*b* in the form of a pulley and with the other end thereof to an attachment 10*b* in the form of a pulley. FIG. 4*b* shows that the cable 12*a* is attached with the one end thereof to the attachment 9*a* in the form of a fixing means and with the other end thereof to the attachment 10*a* in the form of a pulley, while the cable 12*b* is attached with the one end thereof to the attachment 9*b* in the form of a pulley and with the other end thereof to the attachment 10*b* in the form of a fixing means. The difference in applying a pulley instead of a fixing means is in that, when using the pulley the cable is located on a peripheral surface of the pulley, i.e. it is quite spaced from the axis 13*a* and/or the axis 13*b* to a specific distance (see FIG. 4*a*). If the fixing means is used as the attachment, the cable, in fact, surrounds the axis 13*a* and/or the axis 13*b*, i.e. is located as close to the axis as possible (see FIG. 4*b*).

As known to the one skilled in the art, the pulleys 7, 8 for the bowstring 11 and the pulleys used as the attachments 9, 10 for the cables 12*a*, 12*b* can be of round, elongated or complex shape. Said pulleys can be installed on the axis 13*a* and/or the axis 13*b* in centers thereof (a geometric center, or a mass center of the pulley), or shifted, i.e., installed eccentrically. Designs of the pulleys and installation options thereof are disclosed in the above cited prior art documents.

Usually, pulleys installed on the same axis are rotated simultaneously. When armed, a bowstring is strained and the pulleys for the bowstring start unwinding, releasing the bowstring partially located on peripheral surfaces of the pulleys. A torque appeared is transmitted to the pulleys for cables (if attachments for the cables are made in the form of a pulley), and each cable starts winding on the pulley for the cable.

The pulley for the bowstring and the pulleys for the cables are rigidly coupled. All the pulleys can be rigidly attached to the axis and rotate together therewith, or all the pulleys can be made as an integrated unit installed on the axis and rotating irrespectively of the axis, e.g. as shown in FIG. 5 of the U.S. Pat. No. 7,441,555. If the pulleys rotate around the axis, the axis itself needs not necessarily rotate along with the pulleys. Both ends of the cable are wound only when the pulleys are used as the attachments on both loose ends.

Unlike the pulleys, fixing means allow the ends of the cable to roll on the axis even if the pulleys for the bowstring are rigidly secured to the axis. When the fixing means is used as the attachment on one end of the cable, this one end will not be wound when the axis rotates. In general, the fixing means may be avoided at all by simply fastening the end of the cable to the axis, so in this application the fixing means shall be understood in a broad sense: as a means for attaching the end of the cable to the axis, or as a method for such attaching, for example, by knotting the end of the cable or securing the end of the cable with a clamp or the like.

Furthermore, like in the cams known in the art, this invention allows locating the attachments made as the fixing means spaced from the axes. For example, the end of the cable can be secured directly to a limb or to a portion of the limb.

According to the present invention, there is at least one portion of the limb 3 located between the pulley 7 and at least one of the attachments 9*a* and 9*b*. Similarly, there is at least one portion of the limb 4 located between the pulley 8 and at least one of the attachments 10*a* and 10*b*. There are various designs possible that are given in FIGS. 4-10 where the figures with "a" index show the ends of the cables 12*a* and 12*b* fixed by means of the pulleys 9*a* and 10*a* as well as 9*b* and 10*b*, respectively, and the figures with "b" index show the ends of the cables fixed by means of the fixing means 9*a* and the pulley 10*a* as well as the pulley 9*b* and the fixing means 10*b*, respectively.

FIGS. 4*a,b* show the first embodiment of the cam according to the invention where the pulleys 7, 8 for the bowstring 11 are separated from the attachments 9*b*, 10*b* by the portion 3*a* of the limb 3 and the portion 4*a* of the limb 4, respectively. The attachments 9*a*, 10*a* are not separated from the pulleys 7, 8 by at least one portion of the limbs 3, 4, but are, preferably, spaced at some distance from the pulleys 7, 8, which distance is selected so as to ensure free release of an arrow when it is thrown so that the arrow does not come into contact with the cable closest to the bowstring 11 (the cable 12*a* in this case), for instance, with a feathering of the arrow.

As FIGS. 4*a,b* show, within an area between the loose ends 3, 4, the cables 12*a*, 12*b* are located on the same side of the bowstring 11 (in this case below the bowstring 11) and do not intercross when projections of the cables 12*a*, 12*b* onto the drawing's plane are viewed.

Since the distance between the pulley 7 and the attachment 9*b* is rather high, different straining forces of the bowstring 11 and the cable 12*b* will result in appearance of a torque moment acting on the axis 13*a* tending to turn the axis 13*a* clockwise or counterclockwise in the drawing's plane in FIGS. 4*a, b*. This effect is undesirable since it causes increased loading onto the axis 13*a*, especially in the area where the axis 13*a* is connected with the portions 3*a* and 3*b* of the limb 3, and to misalignment of a peripheral surface of the pulley 7 (and a peripheral surface of the pulley 9*b* when used as the attachment), thus leading to increased wear of the bowstring 11 and the cable 12*b*.

As preliminary tests of the claimed cam have shown, when using the pulley 7 and the attachments 9*a*, 9*b* spaced from each other and when the cables 12*a* and 12*b* are located on the same side of the bowstring 11, this is the limb 3 consisting of the two portions 3*a* and 3*b* or more and designed such that there is at least one of the portions 3*a*, 3*b* (the portion 3*a* in this embodiment) located between the pulley 7 and at least one of the attachments (the attachment 9*b* in this embodiment) that allows significantly reducing said undesirable effect.

To further reduce the above undesirable effect it is not strictly necessary but preferably for the portions of the limbs to have different resilience (or resilience properties). According to the above example, the portion 3*a* and the portion 3*b* of the limb 3 may have different resilience. The one skilled in the art will understand that specific values of resilience for the portions 3*a*, 3*b* will depend on performances of the bowstring 11 and the cables 12*a*, 12*b*, lengths of the portions 3*a*, 3*b*, straining force of the bowstring 11, using the pulleys or the fixing means as the attachments, etc.

Also, the one skilled in the art will understand that it is practicable, though not strictly necessary, to choose the same resilience of the portions 3*a* and 4*a* that extend each other, and the same resilience for the portions 3*b* and 4*b*. Nevertheless, it is permitted to use the portions 3*a* and 4*a* and/or the portions 3*b* and 4*b* having different resilience.

The above conditions concerning location and resilience of the portions 3*a*, 4*a* and the portions 3*b*, 4*b* of the respective limbs 3, 4 are applicable to all other embodiments according to FIGS. 5-10, including those that describe the portions 3*a*, 3*b*, 3*c* and the portions 4*a*, 4*b*, 4*c* of the limbs 3, 4.

Figure 5A:
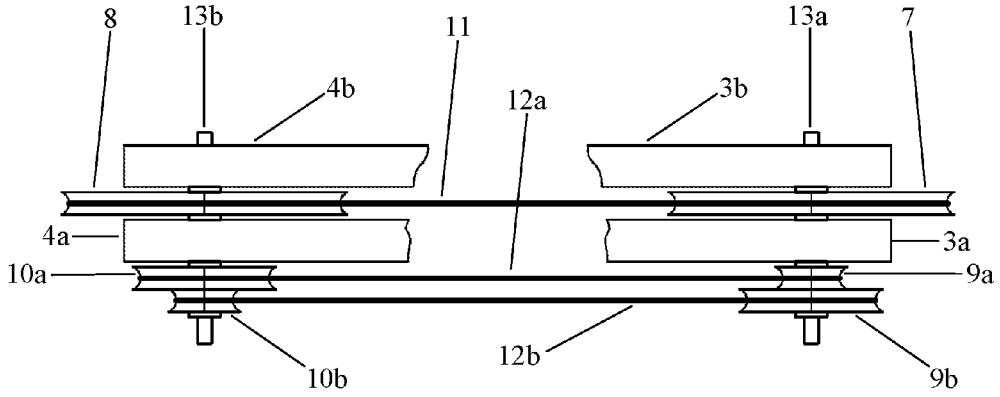
Figure 5B:
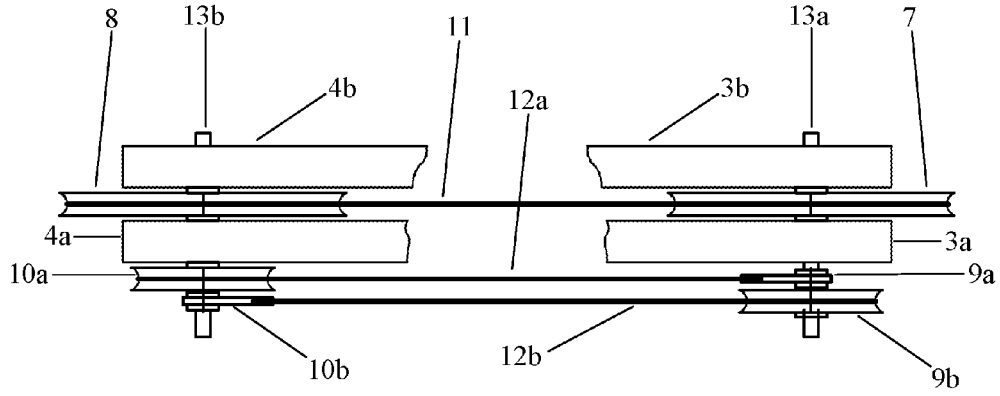

FIGS. 5*a,b* show an embodiment where the pulleys 7, 8 for the bowstring 11 are separated from the both attachments 9, 10 with a one pair of the portions 3*a*, 4*a*. More specifically, referring to the example of the first loose end of the limb 3, the pulley 7 is separated from the attachments 9*a*, 9*b* with the portion 3*a*. The attachments 9*a*, 9*b* are not separated from each other with any portion of the limb 3. In this embodiment, the second portion of the limb 3, i.e. the portion 3*b*, is located above the pulley 7 (as shown in FIGS. 5*a, b*). This embodiment allows to placing the cables 12*a*, 12*b* quite aside of the bowstring 11. In the cams known in the art, however, this would have substantially increased lateral load on the axis 13*a*, while in the cam according to the present invention the lateral load is reduced, thanks to the cam of the claimed design. The load on the axis 13*a* can be further reduced if the portions 3*a*, 3*b* have different resilience, through the difference in resilience may need to be higher than that in the embodiment according to FIGS. 4*a,b* (if the portions of different resilience properties are used).

Figure 6A:
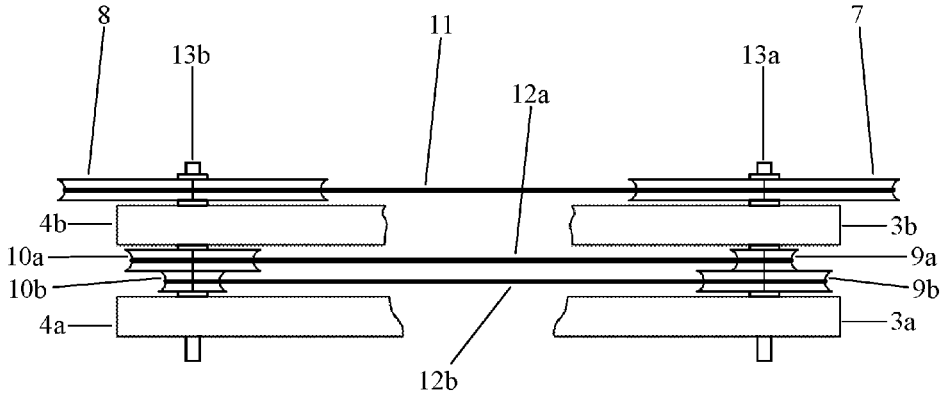
Figure 6B:
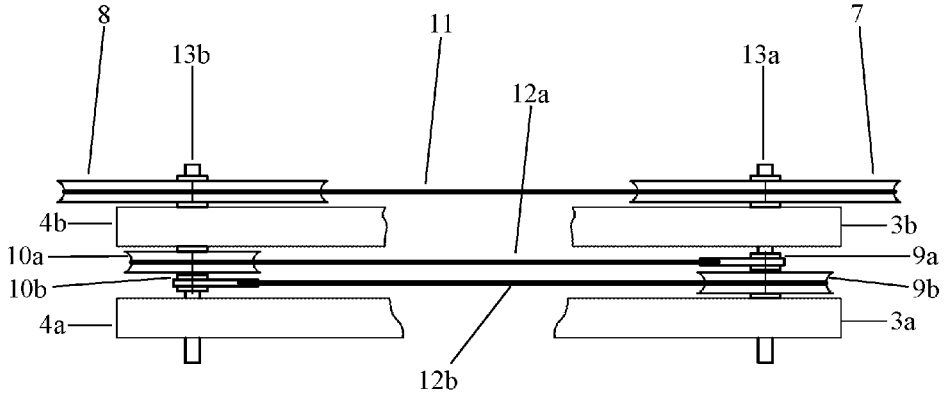

An alternative to the embodiment given in FIGS. 5*a,b* is shown in FIGS. 6*a,b*. Here the pulley 7 is separated from the attachments 9*a*, 9*b* with the portion 3*b*, and the attachments 9*a*, 9*b* are not separated from each other with any portion of the limb 3. The second portion of the limb 3 (in this case, the portion 3*a*) is located under the attachment 9*b*, as shown in FIGS. 6*a,b*.

Yet another alternative to the embodiments given in FIGS. 5*a,b* and FIGS. 6*a,b* is designing the cam with the limbs 3, 4 consisting of three portions—the portions 3*a*, 3*b*, 3*c* and the portions 4*a*, 4*b*, 4*c*, respectively. This embodiment is given in FIG. 7*a,b* where (shown for the limb 3 only for simplicity) the portion 3*a* is located under the attachments 9*a*, 9*b*. These are followed by the portion 3*b*, with the pulley 7 located thereabove, and the portion 3*c* located above the pulley 7. This embodiment is more complex than those shown in FIGS. 5*a,b* and FIGS. 6*a,b*, but it may ensure even lower undesirable loading on the axis 13*a* both in a free position and a strained position of the bowstring 11, which is more difficult to achieve when using the limb 3 consisting of the two portions 3*a*, 3*b* only. Similar to the previous embodiments, even a lower loading on the axis 13*a* can be achieved by choosing resiliences for the three portions 3*a*, 3*b*, 3*c* of the limb 3. Thus, all the portions 3*a*, 3*b*, 3*c* can have different resilience, or the two of them—the portions 3*a* and 3*b*, or the portions 3*a* and 3*c*, or the portions 3*b* and 3*c*—can have the same (or similar) resilience different from resilience of the portion 3*c*, or 3*b*, or 3*a*, respectively.

Figure 8A:
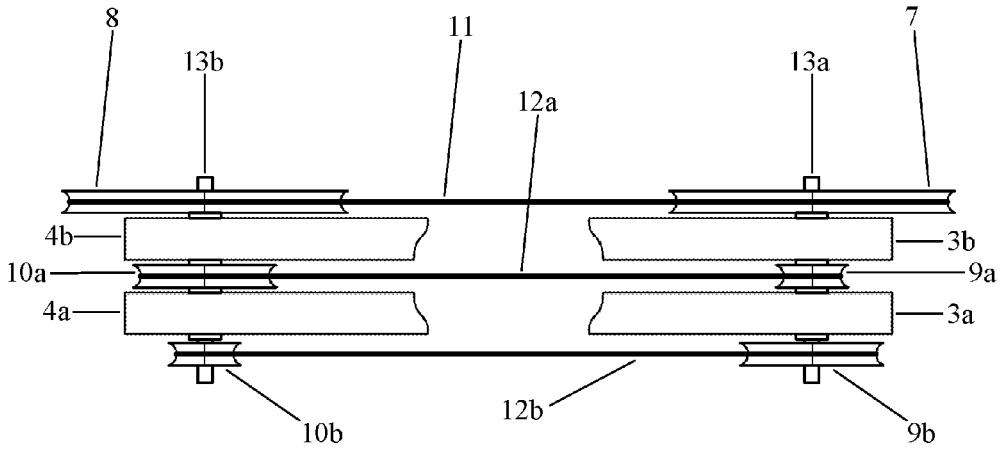
Figure 8B:
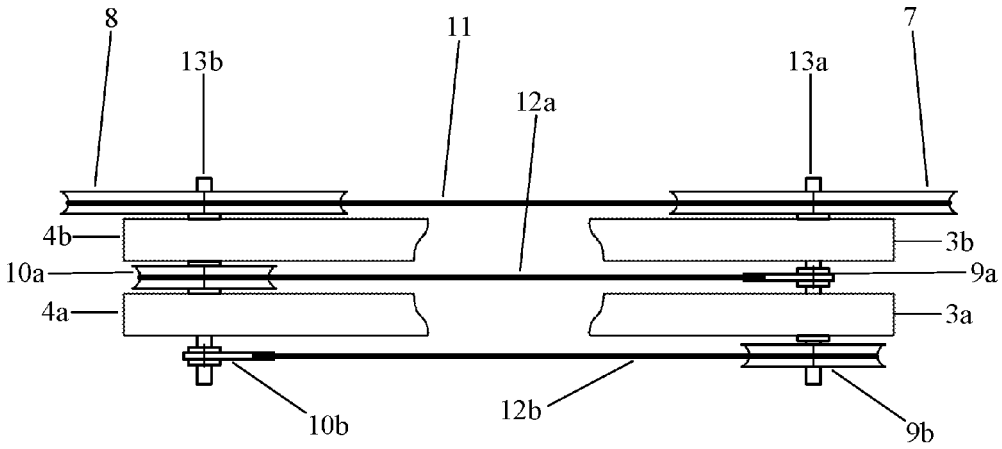
Figure 9A:
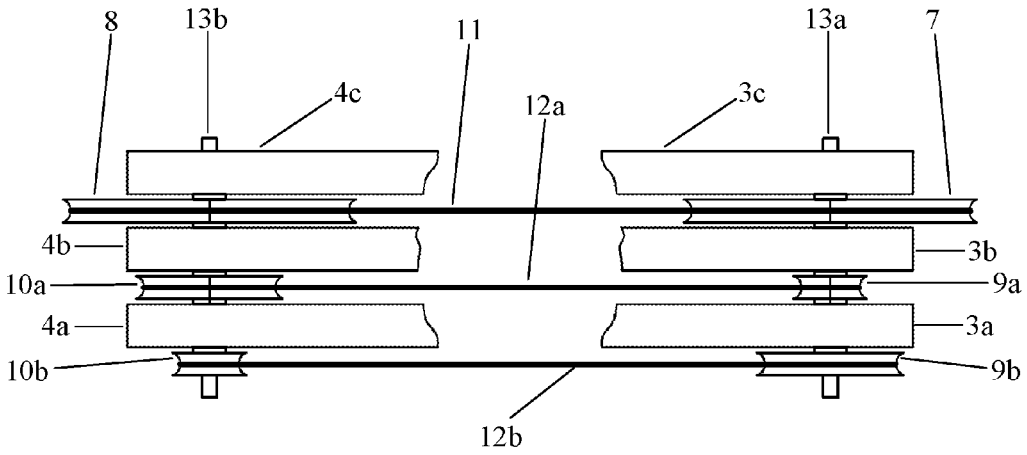
Figure 9B:
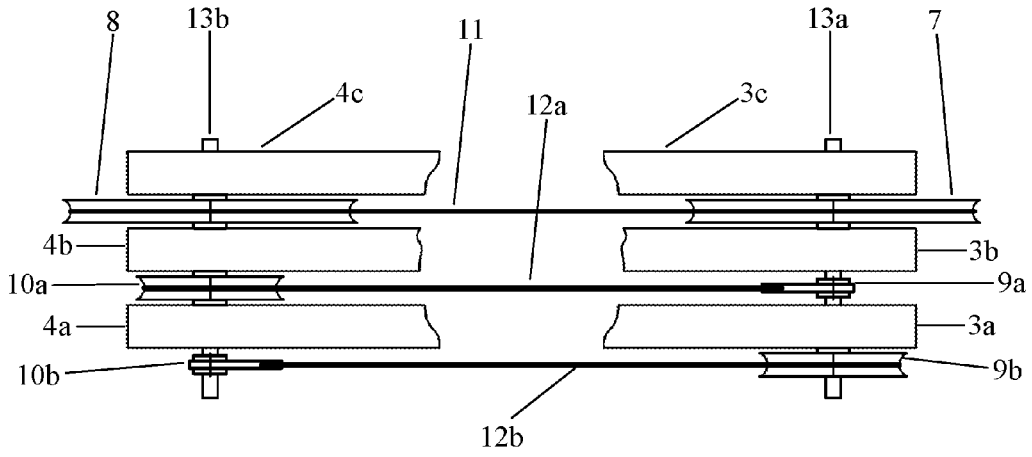

The embodiment given in FIGS. 8*a,b* and FIGS. 9*a,b* show further development of the idea of spacing the pulleys 7, 8 from the attachments 9, 10, the attachments 9*a* and 9*b* from each other, and the attachments 10*a* and 10*b* from each other.

According to FIGS. 8*a,b* and referring to the limb 3 for simplicity, the pulley 7 is separated from the attachment 9*a* with the portion 3*b*, and the attachment 9*a* is separated from the attachment 9*b* with the portion 3*a*. Consequently, the pulley 7 is separated from the attachment 9*b* with two portions—the portion 3*b* and the portion 3*a*.

The embodiment given in FIGS. 9*a,b* differs from the previous one in that the third portion is added, namely the portion 3*c* is installed above the pulley 7 (shown for the limb 3 only). It is obvious that the third portion of the limb 3 could be added not above the pulley 7, but beneath the attachment 9*b*, and therefore the latter is not shown in the figures.

When using the portions 3*a*, 3*b*, 3*c* at least two of which have different resilience, the embodiments according to FIGS. 8*a,b* and FIGS. 9*a,b* allow to more accurately adjusting resilience of the limbs 3, 4 so as to provide the minimal misalignment of the axes 13*a*, 13*b* both in the free condition and the strained condition of the bowstring 11.

Another embodiment of the cam according to this invention that differs from the described above is given in FIGS. 10*a,b* where two portions of each of the limbs 3, 4 are located between the pulleys 7, 8 and the attachments 9, 10. Referring only to the limb 3 for simplicity, the pulley 7 is separated from the attachments 9*a*, 9*b* with the portions 3*a*, 3*b*, while the attachments 9*a*, 9*b* are not separated from each other with any portion of the limb 3. This cam allows spacing the bowstring 11 and the cables 12*a*, 12*b* to such a distance that even using an arrow with a wide feathering will not require additional means to retract the cables 12*a*, 12*b* from the bowstring 11.

Figure 10A:
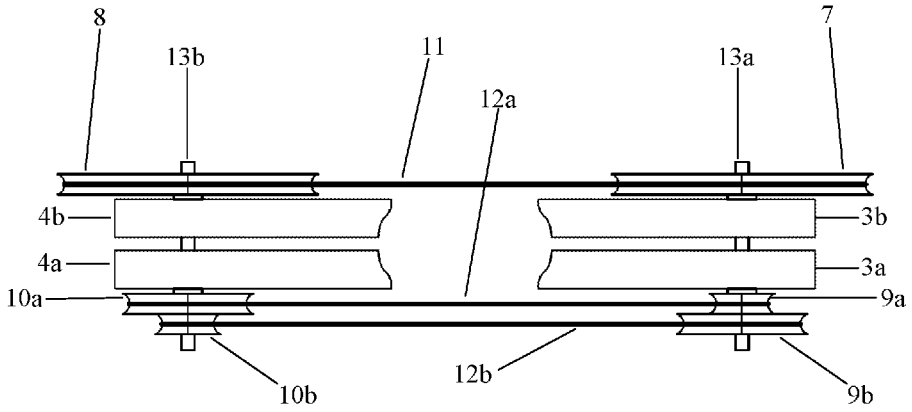
Figure 10B:
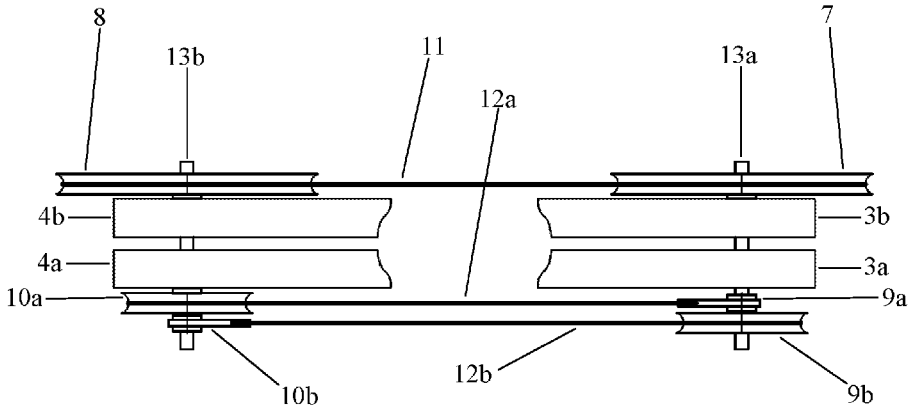

It is understood that the embodiment according to FIGS. 10*a,b* can be modified similar to the above embodiments. In particular, the third portions of each of the limbs 3, 4 can be added to divide the attachments 9*a* and 9*b* and the attachments 10*a* and 10*b*, respectively. Alternatively, the third portions of the limbs 3, 4 can be located above the pulleys 7, 8 or under the attachments 9*b*, 10*b*.

It should be noted that the embodiments in which the attachments 9*a* and 9*b* as well as the attachments 10*a* and 10*b* are not separated with any portions of the limbs 3, 4, which corresponds to FIGS. 5*a,b*, 6*a,b*, 7*a,b* and 10*a,b*, can be made as shown in these figures, i.e. so that the attachment 9*a* is located between the pulley 7 and the attachment 9*b*, and the attachment 10*a* is located between the pulley 8 and the attachment 10*b*. In other words, the first attachment and the second attachment of the first cable (the attachments 9*a*, 10*a*, respectively) are located closer to the first pulley and the second pulley, respectively (to the pulleys 7, 8, respectively), than the first attachment and the second attachment of the second cable (the attachments 9*b*, 10*b*, respectively). This ensures substantially the parallelism of projections of the cables 12*a* and 12*b* onto the planes of the drawings in the given figures.

Figure 7A:
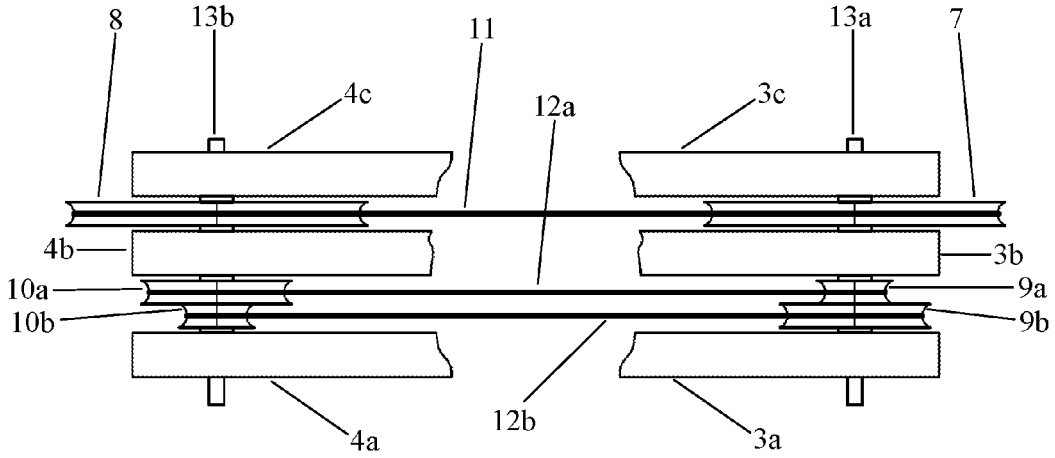
Figure 7B:
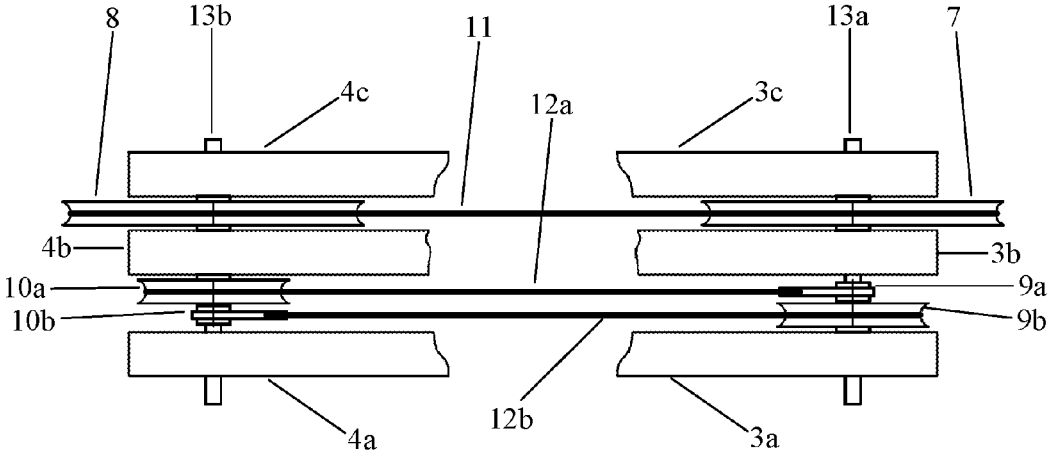

For the one skilled in the art it will be clear that in the embodiments shown in FIGS. 5*a,b*, FIGS. 6*a,b*, FIGS. 7*a,b* and FIGS. 10*a,b*, the two attachments of the same end member can be interchanged, e.g., the attachment 9*a* can be placed between the pulley 7 and the attachment 9*b*, while the attachment 10*a* can be remained to locate between the pulley 8 and the attachment 10*b*. In this case, the projections of the cables 12*a* and 12*b* will cross on the plane of the drawings in the given figures. Contact and friction between the cables 12*a*, 12*b* can be avoided in several ways, namely, by using the attachments 9*a*, 9*b*, 10*a*, 10*b* of various size, or if both the pulleys and the fixing means are used as the attachments 9*a*, 9*b*, 10*a*, 10*b*, etc.

Thus, the present invention provides for a solution for several problems at the same time that are encountered by those who develop cams for compound archery bows, namely:

location of the cables on the same side and spaced from the bowstring that allows increasing shooting comfort and avoid additional means to retract the cables from the bowstring;

avoiding any contact between the cables that increases the initial speed of an arrow as well as reliability and life-time of the cam;

substantial reduction of misalignment of the axes where the end members are installed that also helps increasing reliability and life-time of the cam.

We claim:

1. A split cam for a compound archery bow, the split cam comprising:

a first limb having a first loose end and comprising at least two portions of the first limb extending at least in the area of the first loose end;

a second limb having a second loose end and comprising at least two portions of the second limb extending at least in the area of the second loose end;

a first end member installed with rotation on the first loose end of the first limb and comprising a first pulley, a first attachment for a first cable and a first attachment for a second cable;

a second end member installed with rotation on the second loose end of the second limb and comprising a second pulley, a second attachment for the first cable and a second attachment for the second cable; and a bowstring connecting the first end member and the second end member and partially located on peripheral surfaces of the first pulley and the second pulley, respectively, wherein the first cable connects the first end member and the second end member and secured with ends thereof to the first attachment for the first cable and to the second attachment for the first cable, wherein the second cable connects the first end member and the second end member and secured with ends thereof to the first attachment for the second cable and the second attachment for the second cable, wherein, in an area between the first loose end and the second loose end, the first cable and the second cable are located on the same side of the bowstring, wherein at least one portion of the first limb is located between the first pulley and at least one of the first attachment for the first cable and the first attachment for the second cable, and wherein at least one portion of the second limb is located between the second pulley and at least one of the second attachment for the first cable and the second attachment for the second cable.

2. The split cam, according to claim 1, wherein at least one of the first attachment for the first cable, the second attachment for the first cable, the first attachment for the second cable and the second attachment for the second cable is a pulley having a peripheral surface where the respective cable is partially located.

3. The split cam, according to claim 1, wherein at least one of the first attachment for the first cable, the second attachment for the first cable, the first attachment for the second cable and the second attachment for the second cable is a fixing means.

4. The split cam, according to claim 1, wherein the first attachment and the second attachment for the first cable are located closer to the first pulley and the second pulley, respectively, than the first attachment and the second attachment for the second cable, respectively.

5. The split cam, according to claim 1, wherein at least two portions of said at least two portions of the first limb and/or the second limb have different resilience properties.

6. The split cam, according to claim 5, wherein the portions of the first limb and the second limb representing an extension of each other have the same resilience properties.

7. The split cam, according to claim 1, wherein the first pulley and the second pulley are separated from the first attachment of the first cable, the first attachment of the second cable and the second attachment of the first cable, the second attachment of the second cable, respectively, with one portion of each of the first limb and the second limb, respectively.

8. The split cam, according to claim 1, wherein the first pulley and the second pulley are separated from the first attachment of the first cable, the first attachment of the second cable and the second attachment of the first cable, the second attachment of the second cable, respectively, with two portions of each of the first limb and the second limb, respectively.

9. The split cam, according to claim 7, wherein each of the first limb and the second limb comprises three portions.

10. The split cam, according to claim 1, wherein the first attachment and the second attachment for the first cable are separated from the first attachment and the second attachment for the second cable, respectively, with at least one portion of the first limb and the second limb, respectively.

11. The split cam, according to claim 10, wherein each of the first limb and the second limb comprises three portions.

* * * * *